United States Patent [19]

Howe

[11] Patent Number: 5,067,818

[45] Date of Patent: Nov. 26, 1991

[54] CEMENT MIXER SYSTEM

[76] Inventor: Kenneth J. Howe, 808 Assineboine Crescent, Sarnia, Ontario, Canada, N7T 7C4

[21] Appl. No.: 299,434

[22] Filed: Jan. 23, 1989

[51] Int. Cl.[5] ..... B28C 7/16; B28C 5/42

[52] U.S. Cl. ..... 366/46; 366/47; 366/67; 366/185; 366/189; 366/250; 366/606

[58] Field of Search ..... 366/45–48, 366/60, 61–64, 67, 185, 189, 194–196, 279, 309, 312, 241, 244, 245, 250, 606; 414/405, 425, 697

[56] References Cited

U.S. PATENT DOCUMENTS

| | | | |
|---|---|---|---|
| 1,848,959 | 3/1932 | Longenecker | 366/45 X |
| 2,492,895 | 12/1949 | Schulz | 366/60 |
| 2,580,551 | 1/1952 | Kacena | 366/67 |
| 2,801,833 | 8/1957 | Huge | 366/60 |
| 2,970,820 | 2/1961 | Sepich | 366/47 |
| 3,062,515 | 11/1962 | Green | 366/47 |
| 3,190,620 | 6/1965 | Saveraid | 366/606 |
| 3,430,931 | 3/1969 | Desko | 366/64 |
| 3,905,519 | 9/1975 | Tertinek et al. | 366/45 X |
| 4,211,491 | 7/1980 | Chaney et al. | 366/46 X |
| 4,699,517 | 10/1987 | Sella | 366/45 |

FOREIGN PATENT DOCUMENTS

| | | | |
|---|---|---|---|
| 839025 | 6/1960 | United Kingdom | 366/61 |
| 935345 | 8/1963 | United Kingdom | 366/61 |
| 936493 | 9/1963 | United Kingdom | 366/61 |
| 1580788 | 12/1980 | United Kingdom | 366/45 |

*Primary Examiner*—Harvey C. Hornsby
*Assistant Examiner*—C. Cooley
*Attorney, Agent, or Firm*—McFadden, Fincham, Marcus & Anissimoff

[57] ABSTRACT

A cement mixer is provided for use with a pick-up truck, generally as a retrofit to an existing truck. The cement mixer can sit on the truck bed, having pivot mounts that engage the tailgate brackets, to facilitate dumping of a mix from the mixer. The system utilizes a hydraulic circuit connected in parallel with the truck power steering circuit. A shut-off valve redirects the hydraulic fluid to the auxiliary circuit, in driving relation with a hydraulic motor that powers the mixer paddles of the mixer.

7 Claims, 3 Drawing Sheets

CEMENT MIXER SYSTEM

FIELD OF THE INVENTION

This invention is directed to a mixing device, and in particular to a cement mixer adapted to be mounted on the box of a pick-up truck, and to the system therefor.

BACKGROUND TO THE INVENTION

The concept of a portable cement mixer is not new, and the provision thereof upon trailers is well known.

Certain aspects of the prior art in relation thereto are shown in the following listed United States patents:

| | | |
|---|---|---|
| 2,397,324 | March, 1946 | Muckley |
| 2,492,895 | December, 1949 | Schulz |
| 2,801,833 | August, 1957 | Huge |
| 4,441,820 | April, 1984 | Maxon |
| 4,452,536 | June, 1984 | Hinkle |

However, these various prior art arrangements are characterized by a number of disadvantages, primarily the loss of total truck mobility, and the difficulty of utilization.

SUMMARY OF THE INVENTION

The present invention provides a mixer system for use with a pick-up truck. Furthermore, the present system is adapted for fitting as a retrofit to an existing truck.

In the preferred embodiment there is provided a mixer for use with a pick-up truck, comprising an elongated body of predetermined length having an upwardly facing access opening; a mounting bracket at each end of the body extending therebelow, each bracket having an outwardly extending pivot pin located on a pivotal axis extending parallel with the main axis of the body to engage a tailgate pivot bracket of the pick-up truck, in supporting relation with the mixer body; handle means extending from the body in spaced relation from the pivotal axis, to facilitate pivoting of the mixer body about the pivotal axis; mixer paddle means within a mixing compartment portion of the mixer body; and driving means connected in driving relation with the mixer paddle means, to enable operation of the mixer when in installed relation on the truck.

In the preferred embodiment the driving means comprises a motor connectible in driven relation to one of the truck's own power systems. Preferably, the paddle driving motor comprises a hydraulic motor connected with the power steering system of the truck.

An alternative embodiment utilizes an electric motor, generally powered by the truck electrical system.

In the arrangement of the mixer in relation to the truck bed, the pivot pins are located in laterally spaced relation from a portion of the mixer body that underlies the center of gravity of the mixer when charged, so that in use the pivot pins are located in secured relation in the tailgate pivot brackets, and the body portion is located in overlying relation with a portion of the bed of the truck, being in stabilizing relation by the pivot pins.

It will be understood that the mixer in accordance with the present invention can be manufactured for retrofit to an existing truck, wherein the truck systems, either the electrical system or the hydraulic power system, are modified in order to make available a power attachment for driving the mixer paddle means.

Furthermore, the mixer can be initially incorporated into the truck structure.

It has generally been found that the mixing compartment of the mixer need comprise only a portion of the truck width; i.e. the mixing compartment comprises a portion of the total length of the mixer.

In the preferred embodiment the mixer paddle means is mounted for rotation about an axis substantially parallel with the main axis of the body of the mixer. The preferred mixer paddle embodiment comprises a plurality of blade portions. In the preferred embodiment the blade portions are secured in skewed relation about the outer periphery of the mixer paddle wheel.

The provision of rubber scrapers to form the tip of the mixer paddle means, in scraping relation with an arcuate segment of the mixing compartment, is contemplated. The use of rubber scrapers provides an economic and efficient seal between the tip of the mixer paddle means and the arcuate segment of the mixing compartment.

The construction of the mixer from aluminum or an alloy thereof, which has the advantage of being lightweight and free of rust, is contemplated.

The present invention further provides a hydraulic power circuit connected in driving relation with the mixer motor, the hydraulic power circuit being connected in parallel with the power steering circuit of the vehicle.

BRIEF OF DESCRIPTION OF THE DRAWINGS

Certain embodiments of the invention are described by way of illustration, and without limitation thereto, reference being made to the accompanying drawings, wherein.

DETAILED DESCRIPTION OF THE INVENTION

Figure 1:
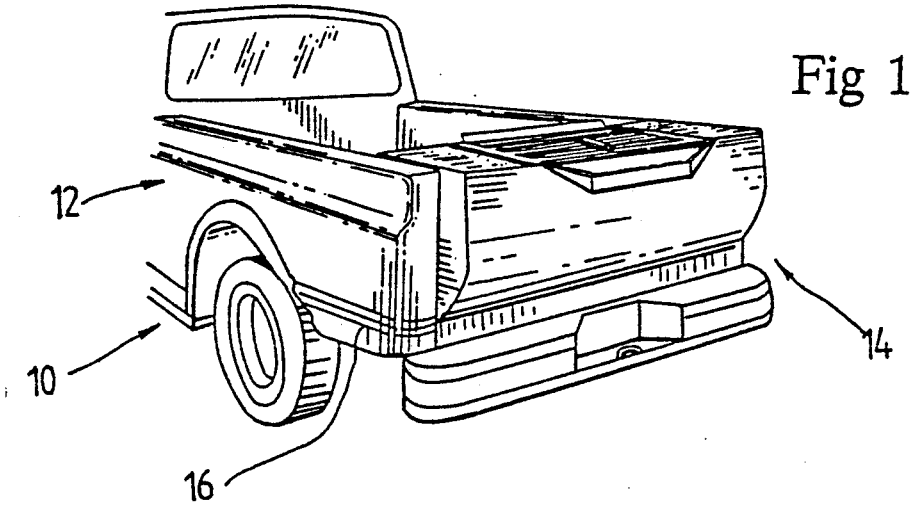
FIG. 1 is a general view of a portion of a pick-up truck incorporating a cement mixer in accordance with the present invention in a stowed relation thereon.
Figure 2:
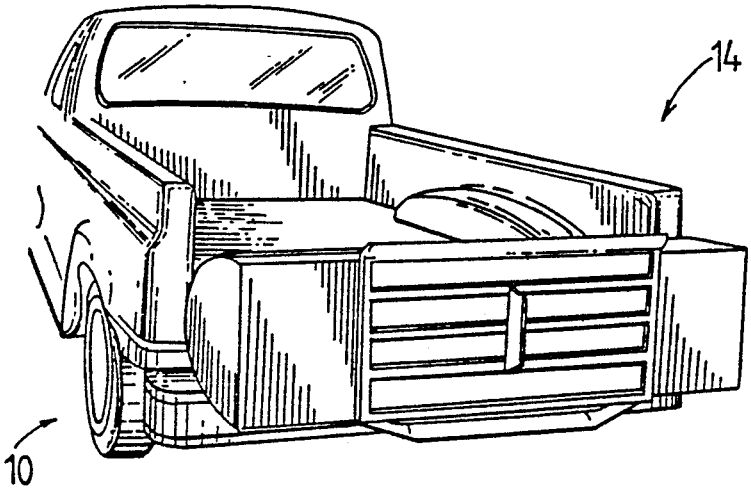
FIG. 2 is a general view similar to FIG. 1, showing the mixer in a dumped condition.

Referring to FIGS. 1 and 2, in FIG. 1 the arrangement 10 comprises a pick-up truck 12 having a cement mixer 14 in accordance with the present invention mounted in the tailgate zone 16 of the truck 12. In the illustrated arrangement the mixer 14 is in an upright, stowed condition.

Referring to FIG. 2 the arrangement 10 shows the mixer 14 in its "as-dumped" condition. It will be observed that the mixing compartment occupies somewhat more than one half of the total volume of the mixer, located substantially symetrically in the center thereof.

Figure 3:
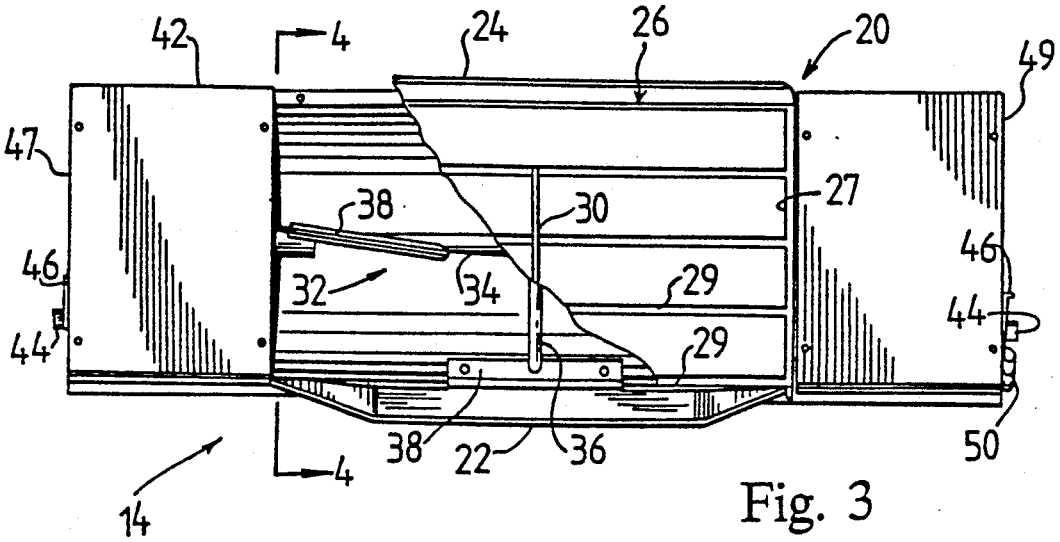
FIG. 3 is a plan view of the mixer in partial section.

Referring to FIG. 3 which is a plan view, the sides of the mixer are bounded at the top edges by a pouring spout 22 and a splash guard 24. A grill 26 comprising bars 27, 29 includes an upwardly projecting back splitter plate 30 by which bags of cement or aggregate can be torn open, simply by being dumped across the splitter plate 30. Elevation of the opposed ends of the bag then produces dumping of the contents thereof through the grill 26.

Within the mixing chamber 20 the mixer paddle means 32 has a central shaft 34 having radially extending arms 36 on which are mounted mixer arms 38. The arms 38 are skewed, so as to impart an axial mixing component to the contents of the compartment 20.

A flexible coupling 40 connects the mixer shaft 34 with a hydraulic motor located in the off-side end compartment 42.

Also to be seen in this view are pivot pins 44, for mounting the mixer 14 to the tailgate brackets of the truck 12. A pair of axially projecting stop members 46 secured to the ends 47, 49 of the mixer 14 serve to position the mixer 14 when in an upright position against the end of the truck side walls, to prevent the mixer 14 toppling inwardly into the truck bed. The dumping handle 50 also can be seen.

Figure 4:
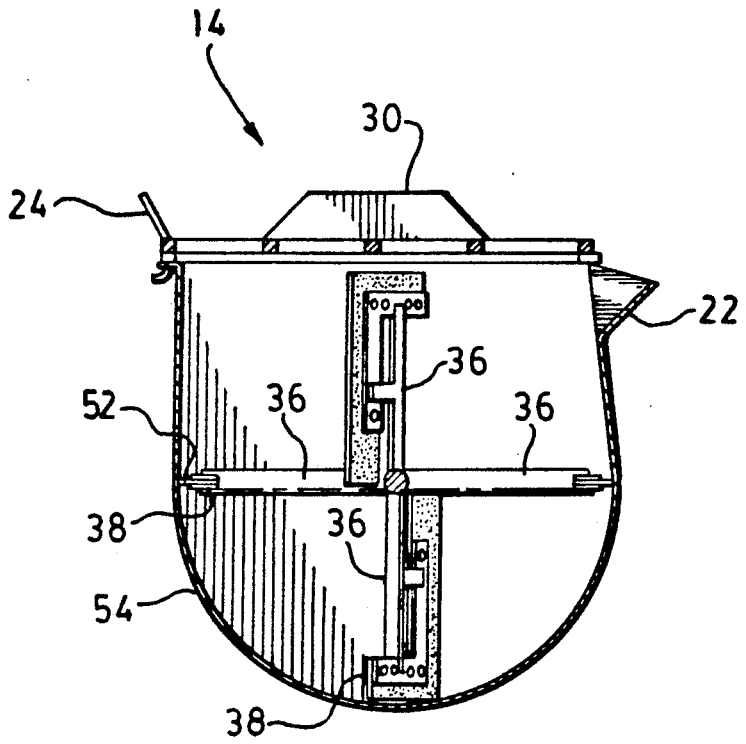
FIG. 4 is a side elevation taken in section at 4—4 of FIG. 3.

Referring to FIG. 4, rubber blade portions 52 at the radially outer edges of the mixer blades 38 can be clearly seen. The arcuate bottom portion 54 of mixer 14 is clearly evident.

Figure 5:
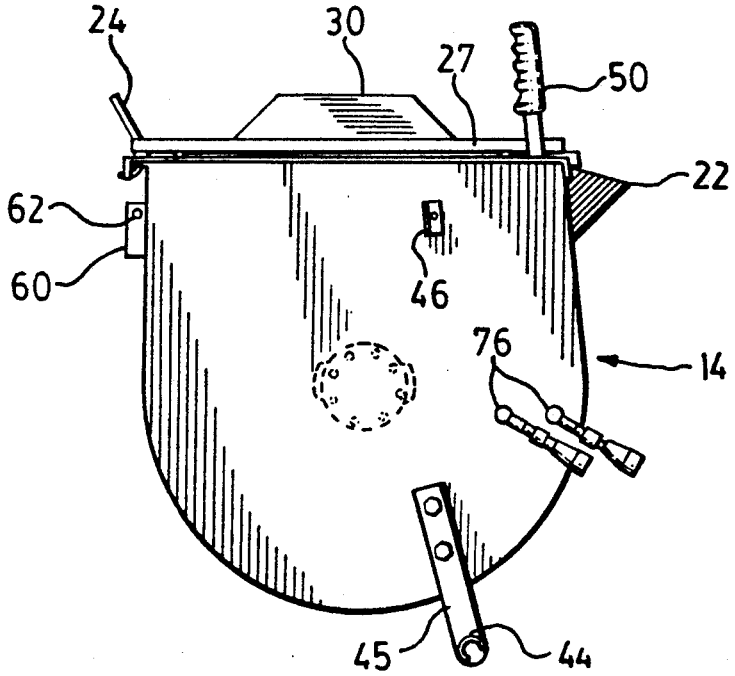
FIG. 5 is an end elevation taken from the off-side of the vehicle.

Referring to FIG. 5 pivot pins 44 are mounted on bracket arms 45, to position the pins 44 forwardly of the mixer 14, i.e. towards the rear of the vehicle so that the center of gravity of mixer 14, which is located substantially on the centre line of shaft 34, lies within the vehicle.

A pair of latch plates 60 in combination with a pair of latch pins 62 provide positive securement of the mixer 14 in the upright condition to the truck 12.

Figure 6:
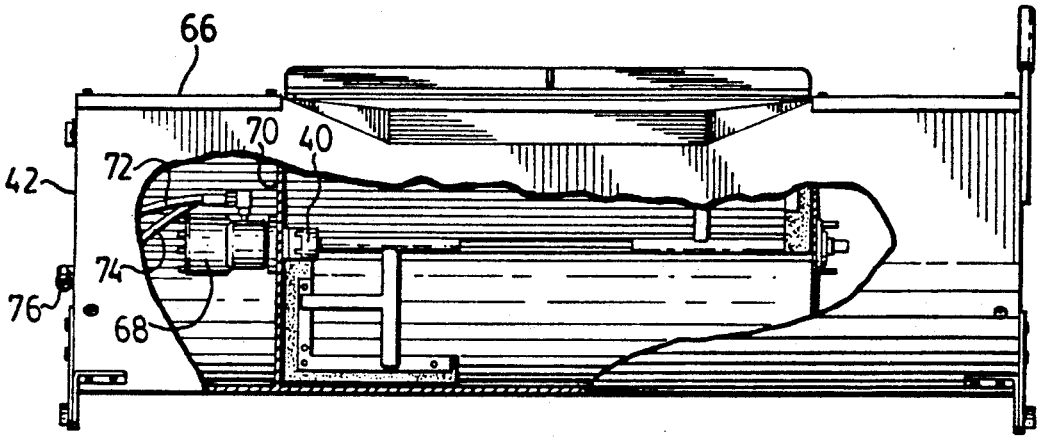
FIG. 6 is a front elevation (from the vehicle rear) of the left hand portion of the mixer; and, FIG. 7 is a schematic circuit diagram of a hydraulic system for driving the mixer.

Referring to FIG. 6, within the compartment 42, which is provided with a removable cover 66, is located a hydraulic motor 68 that is mounted on the bulkhead 70 and connected therethrough in driving relation with the coupling 40. The hydraulic lines 72, 74 connect with external connectors 76 to which quick disconnect hydraulic connectors are attached.

Figure 7:
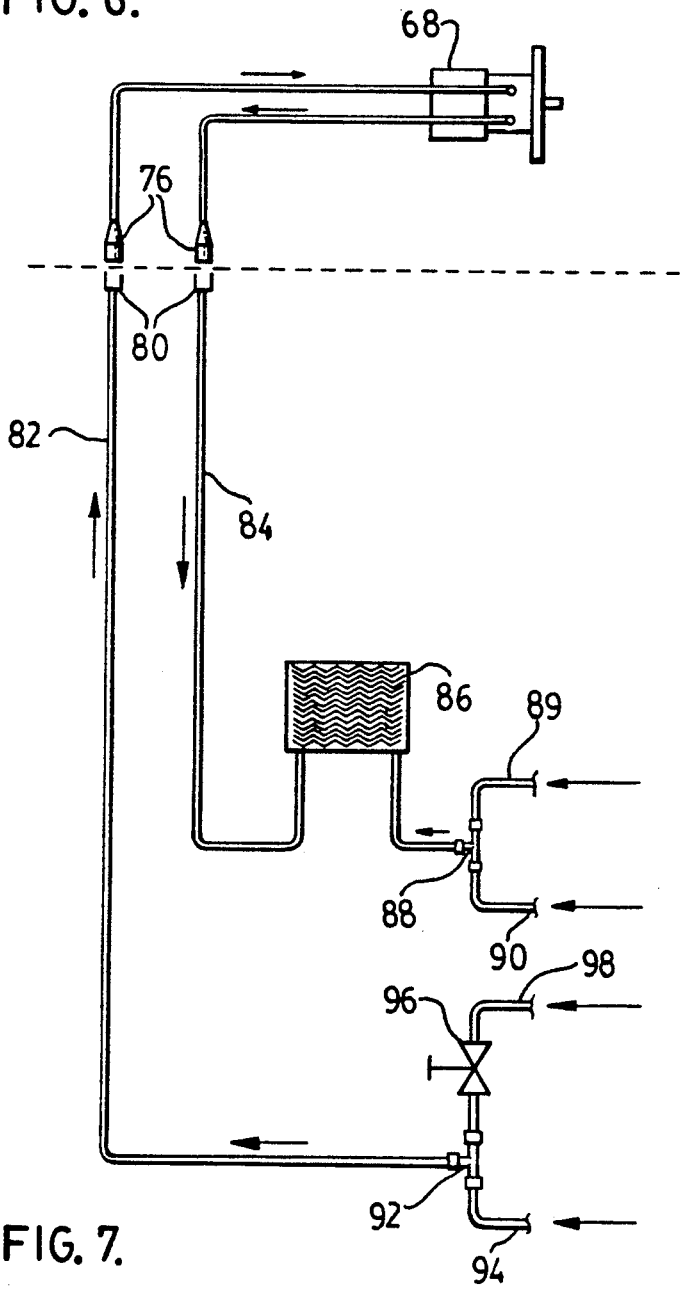

Referring to FIG. 7 the hydraulic motor 68 and its quick disconnect fittings 76 are connected by way of quick release fittings 80 and flexible hoses 82, 84 to the vehicle hydraulic system.

The return line 84 connects to the vehicle oil cooler 86, and from there, by way of a tee fitting 88, to the power steering pump return connection 90. Thus it will be seen that interposition of the tee fitting 88 into the power steering pump return line, between an inlet 89 coming from the power steering and the pump return 90, provides connection for the hydraulic return feed.

The inlet 82 of pump 68 connects with tee fitting 92 that is connected to the power steering pump outlet 94.

A control valve 96 enables the shutting off of the power steering connection 98 such that all, or a portion, of the power output from the power steering pump can be directed to the mixer 14.

What I claim by Letters Patent of the United States is:

1. A mixer for installation in a pick-up truck, comprising:

a unitary elongate body having a longitudinal axis, an arcuate bottom surface, and an access to said body, said body divided into a mixer section and a power section;

mixing means mounted in said mixer section for rotation about said longitudinal axis;

motor means in said power section connected to said mixing means for rotation of said mixing means;

mounting means at each end of said body for pivotally mounting said body on tailgate pivots of a pick-up truck, said mounting means including pivotal supports extending from said body and positioned on a pivotal axis, said pivotal axis extending parallel to and spaced from said longitudinal axis and positioned external to said arcuate bottom surface below said longitudinal axis when said body is in an upright position; locating and retaining means on said body for releasably locating and locking said body in an upright position on said truck a release of said locating retaining means permitting pivoting of said body about said pivotal axis for discharge from said body.

2. The mixer as set forth in claim 1, in combination with said truck, said motor means being connected with a power steering hydraulic energizing circuit of the truck.

3. The mixer as set forth in claim 1, said mixing means having a plurality of blade portions secured in skewed relation relative said axis of rotation.

4. The mixer as set forth in claim 3, said blade portions including rubber scrapers secured thereto.

5. The mixer as set forth in claim 1, said mixer section having a plurality of bars extending in mutually spaced relation thereacross to provide a covering grill for supporting a paper sack upon the grill.

6. The mixer as set forth in claim 5, said covering grill having an upstanding blade plate extending above the grill, to receive and split a paper sack to free contents of the paper sack for downward passage through the grill.

7. The mixer as set forth in claim 1, said motor means including means for connection to a power supply in said truck.

* * * * *